United States Patent [19]

Swanson

[11] 3,954,515

[45] May 4, 1976

[54] PRODUCTION OF SUPERPLASTIC ZINC-ALUMINIUM ALLOY SHEET

[75] Inventor: Colin John Swanson, Bristol, England

[73] Assignee: ISC Alloys Limited, Bristol, England

[22] Filed: Apr. 7, 1975

[21] Appl. No.: 565,825

[30] Foreign Application Priority Data

May 1, 1974 United Kingdom ..... 19156/74

[52] U.S. Cl. ..... 148/11.5 R

[51] Int. Cl.[2] ..... C22C 18/04; C22F 1/16

[58] Field of Search ..... 148/11.5 R

[56] References Cited

UNITED STATES PATENTS

| | | | |
|---|---|---|---|
| 3,676,115 | 7/1972 | Hare et al. | 148/11.5 R |
| 3,753,791 | 8/1973 | Swanson | 148/11.5 R |
| 3,793,091 | 2/1974 | Gervais et al. | 148/11.5 R |
| 3,798,028 | 3/1974 | Gervais et al. | 75/178 AM |
| 3,850,622 | 11/1974 | Balliet | 75/178 AM |

*Primary Examiner*—W. Stallard

*Attorney, Agent, or Firm*—Holman & Stern

[57] ABSTRACT

A process for providing superplastic properties in a Zinc/aluminium alloy containing between 18 and 40% by weight of aluminium, comprising heat-treating a body of the alloy until a substantially homogeneous structure is obtained, cooling the body of alloy to a temperature below 275°C, and working the body of alloy to reduce a dimension thereof by at least 90%, wherein the body of alloy is initially cooled to a temperature of not less than 275°C and is subsequently further cooled after the body of alloy has been at least partially worked, and wherein more than half of the total percentage dimension reduction is carried out at 275°C or above.

5 Claims, No Drawings

PRODUCTION OF SUPERPLASTIC ZINC-ALUMINIUM ALLOY SHEET

This invention relates to the production of superplastic zinc-aluminium alloy sheet material.

The invention particularly relates to an improvement in or modification of the treatment described in British Pat. No. 1,297,101, which describes and claims a process for providing superplastic properties in alloys of zinc and aluminium by means of an homogenizing/slow cooling/working process.

Specifically, British Pat. No. 1297101 claims a process for providing superplastic properties in alloys of zinc and aluminium, comprising: (a) heat-treating a body of the alloy containing between 18 and 40% by weight of aluminium, the remainder being zinc together with any incidental impurities and minor ternary alloying components and alloy composition and temperature being such as to fall within the aluminium rich single-phase region of the zinc-aluminum phase diagram, until a substantially homogeneous structure is obtained, and thereafter characterized by: (b) cooling the body of alloy to a temperature below 275°C at a cooling rate not in excess of 10°C per minute, and (c) working the body of alloy to reduce a dimension thereof by at least 90%, at least half of the total percentage dimension reduction being carried out below 275°C and all the said percentage dimension reduction being carried out above 200°C.

The working stage of the process described in British Pat. No. 1297101 comprises working the body of alloy to reduce a dimension thereof by at least 90%, at least half the percentage reduction being carried out below 275°C and all the 90% reduction being carried out above 200°C. Although this process results in a superplastic sheet material of adequate vacuum forming time (measured by the test set out below) there is a tendency for surface defects, and more particularly edge-cracks, to be formed in the sheet so produced.

We have now found that the presence of such cracks can be avoided or reduced by means of an improvement in or modification of the process described in British Pat. No. 1,297,101.

The present invention provides a process for providing superplastic properties in sheet material of alloys of zinc and aluminium according to the process described and claimed in British Pat. No. 1,297,101, wherein the body of alloy is initially cooled to a temperature of not less than 275°C and is subsequently further cooled after the body of alloy has been at least partially worked, and wherein more than half of the total percentage dimension reduction is carried out at 275°C or above.

Although this modification results in a certain reduction of vacuum forming time it would appear that this is outweighed by the advantage that the formation of edge cracks is reduced or eliminated.

The working is suitably effected by rolling.

Preferably more than half the total percentage dimension reduction is carried out during the phase change which occurs at 275°C.

The body of alloy may be further reduced (over and above 90%) in a subsequent step, at a temperature below 200°C, to a gauge between 1 mm and 2 mm.

It is expedient to reduce the dimension of the body of alloy by at least 70% at 275°C or above.

The invention will be further described with reference to the following example.

EXAMPLE

An ingot of zinc/aluminium alloy containing 78% by weight Zn, 22% by weight Al and 0.15% by weight Cu of dimensions 84 mm × 635 mm × 1219 mm was annealed at 340°C for 28 hours. The ingot was air-cooled to 275°C over 1 hour (this represents a cooling rate of just over 1°C per minute) and then rolled from 84 mm thickness to 19 mm thickness at 2.5 mm reduction per pass initially and 5 mm per pass subsequently, during which time the temperature remained at 275°C (this was the temperature measured at the surface of the ingot, the internal temperature being appreciably higher due to the exothermic phase change taking place at 275°C). This amounted to 77% reduction on starting thickness at 275°C or above. The partially-rolled slab was cooled to 230° to 240°C and rolling was continued at 2.5 mm and then 5 mm per pass. The final gauge was 5 mm and the temperature was 205°C. At this stage edge-cracking had just started. The total reduction from starting thickness amounted to 94%, all of which was carried out at above 200°C. A further reduction in gauge to 1.3 mm (giving a total reduction of 98.5% based on starting thickness) was carried out at temperatures below 200°C at which gauge a satisfactory vacuum forming time of about 400 secs. was obtained by the standard procedure set out in British Pat. No. 1,297,101.

The vacuum forming test is performed as follows:

1. a disc of alloy is clamped over the end of a tube of internal diameter 3.2 inches maintained in a thermostatted air enclosure;
2, vacuum is applied to one side of the disc; and
3. the time taken to form the disc into a part of a hemisphere of 1.15 inches radius is measured, i.e. to increase the relevant area by 50%, a suitable probe being used to establish when the hemispherical condition is reached.

Further details of the process may be obtained by reference to British Pat. No. 1,297,101 (equivalent to U.S. Pat. No. 3,753,791).

I claim:

1. In a process for providing superplastic properties in alloys of zinc and aluminium, comprising (a) heat-treating a body of the alloy containing between 18 and 40% by weight of aluminium, the remainder being zinc together with any incidental impurities and minor ternary alloying components and alloy composition and temperature being such as to fall within the aluminium rich single-phase region of the zinc-aluminium phase diagram, until a substantially homogeneous structure is obtained, and thereafter (b) cooling the body of alloy to a temperature below 275°C at a cooling rate not in excess of 10°C per minute, and (c) working the body of alloy to reduce a dimension thereof by at least 90%, all the said percentage dimension reduction being carried out above 200°C, the improvement comprising initially cooling the body of alloy to a temperature of not less than 275°C and subsequently further cooling the body of alloy after the same has been at least partially worked, and carrying out more than half of the total percentage dimension reduction at a temperature of at least 275°C.

2. A process as claimed in claim 1 comprising effecting the working by rolling.

3. A process as claimed in claim 1 comprising carrying out more than half the total percentage dimension reduction during the phase change which occurs at

275°C.

4. A process as claimed in claim 1 comprising reducing the dimension of the body of alloy by at least 70% at a temperature of at least 275°C.

5. A process as claimed in claim 1 comprising further reducing the body of alloy in a subsequent step at a temperature below 200°C to a gauge between 1mm and 2mm.

* * * * *